United States Patent [19]

Jasinski

[11] 3,971,054

[45] July 20, 1976

[54] METHOD AND APPARATUS FOR MAGNETIZING PERMANENT MAGNET IN MAGNETIC STRUCTURE

[75] Inventor: Leon Jasinski, Fort Lauderdale, Fla.

[73] Assignee: Motorola, Inc., Schaumburg, Ill.

[22] Filed: July 12, 1974

[21] Appl. No.: 488,612

[52] U.S. Cl. ..... 335/284; 29/594; 148/108; 335/231

[51] Int. Cl.[2] ..... H01F 13/00

[58] Field of Search ..... 335/284, 231; 29/594; 179/117; 317/157.5 PM; 148/103, 104, 105, 108

[56] References Cited

UNITED STATES PATENTS

| | | | |
|---|---|---|---|
| 3,417,295 | 12/1968 | Littwin | 335/284 |
| 3,440,364 | 4/1969 | Parker | 179/117 |
| 3,550,051 | 12/1970 | Parker | 335/231 |

*Primary Examiner*—Harold Broome

*Attorney, Agent, or Firm*—Donald B. Southard; James W. Gillman

[57] ABSTRACT

The permanent magnet of a magnetic structure is formed of isotropic magnetic material, and is magnetized along the path that the flux follows during use of the magnetic structure to increase the efficiency of the magnetic structure in use. The magnetic structure, which may be the annular magnetic structure of an electrodynamic loudspeaker, includes a cylindrical permanent magnet and an annular cup-like return path element connected to the magnet at one end thereof and forming an air gap with the magnet at the opposite end. Apparatus is provided for magnetizing the permanent magnet having an annular portion which may extend into the air gap of the speaker magnetic structure, to provide curved magnetic lines in the permanent magnet in substantially the path of the operating flux to the air gap. The end of the magnet opposite the air gap may be mounted in a recess in the magnetic return path element and the magnetizing apparatus may engage the return path element about such end of the magnet to provide curved magnetizing lines in the part of the magnet which is set into the recess in the element.

10 Claims, 7 Drawing Figures

METHOD AND APPARATUS FOR MAGNETIZING PERMANENT MAGNET IN MAGNETIC STRUCTURE

BACKGROUND OF THE INVENTION

Magnetic structures for loudspeakers of the electrodynamic type have an annular air gap in which the moving coil operates to drive a diaphragm. For maximum efficiency, the magnetic flux density in the air gap should be very high. Such magnetic structures commonly have a permanent magnet of cylindrical configuration with a cup-like annular return path element of soft magnetic material within which the permanent magnet is positioned, with one end of the permanent magnet in engagement with the center of the return path element and the other end of the magnet forming an air gap with an annular rim on the return path element. A pole piece, which may be made of soft magnetic material, can be provided on the top end of the permanent magnet to form the air gap with the return path element.

The cylindrical permanent magnet of the loudspeaker magnetic structure which has been described is normally magnetized in an axial direction by use of magnetizing apparatus which engages the opposite ends of the magnet, to provide axial flux lines within the magnet. However, when the magnetic structure is used, the magnetic flux path from the magnet to the air gap must curve within the permanent magnet and enter the air gap at a circumference of one end of the magnet. The permanent magnet with an axially magnetized flux path is inefficient to provide the curved flux path to the air gap, and this results in a reduction in the flux density in the air gap with respect to that which would be provided by a permanent magnet in which the flux lines are curved.

Although it has been proposed to construct a permanent magnet having a preferred direction of magnetization along a curved path within the magnetic material, such an anisotropic magnet must be constructed by a special process which is much more expensive than the normal process for constructing permanent magnet materials.

SUMMARY OF THE INVENTION

It is an object of the present invention to provide an improved method and apparatus for magnetizing a permanent magnet in a magnetic structure.

A further object of the invention is to provide a method for magnetizing the permanent magnet of the magnetic structure for a loudspeaker in which the permanent magnet is magnetized along curved lines which form the flux path in the magnetic structure when used in a loudspeaker.

Another object of the invention is to provide magnetizing apparatus for the magnetic structure of a loudspeaker which has a permanent magnet providing a flux path through an air gap, wherein the magnetizing apparatus has a portion extending into the air gap to provide curved magnetic paths from the air gap into the permanent magnet.

A still further object of the invention is to provide a magnetizing apparatus for the cylindrical permanent magnet of a speaker magnetic structure wherein one end of the magnet cooperates with a cup-like return path element to form an air gap and the other end of the magnet is set in a recess in the return path element, wherein the magnetizing apparatus engages the magnetic structure adjacent the air gap and at the periphery of the return path element adjacent the other end of the magnet to provide curved magnetic lines extending from the circumference of the magnet adjacent the air gap axially through the magnet and back to the circumference at the end of the magnet set into the return path element.

In accordance with the invention, a magnetizing method and apparatus are provided for the magnetic structure of a loudspeaker which includes a cylindrical permanent magnet and a cup-like return path engaging the magnet at one end and forming an air gap with the magnet at the opposite end. The permanent magnet provides flux within the air gap for operation of the speaker, and the flux lines extend from the permanent magnet outwardly at a circumference of the magnet at the end thereof adjacent the air gap. The magnetizing apparatus has an annular portion engaging the magnetic structure to provide flux from the air gap into the permanent magnet, and sufficient flux through the return element to saturate the same. Magnetic flux is applied through the permanent magnet from the circumference thereof and axially within the magnet to the opposite end thereof to magnetize the permanent magnet. The magnetizing apparatus may have a portion extending into the air gap of the magnetic structure. For use with a magnetic structure wherein the end of the magnet opposite to the air gap is set in a recess in the return element, the magnetizing apparatus has a portion coupled to such opposite end of the magnet which engages the return path around the periphery thereof so that the magnetizing lines extend from the cup-like element into the permanent magnet at the circumference thereof, and are curved to continue axially toward the end of the magnet adjacent the air gap and then are curved back to the circumference of the magnet at the air gap.

The magnetizing method can be used with an isotropic permanent magnet, or with specially processed or constructed anisotropic magnets. A specially processed anisotropic magnet has curved preferred direction of magnetization along which it is magnetized using the described method. A specially constructed anisotropic magnet with an axial preferred path of magnetization may have pole pieces made of isotropic magnetic material which are magnetized along a curved path.

DETAILED DESCRIPTION

Figure 1:
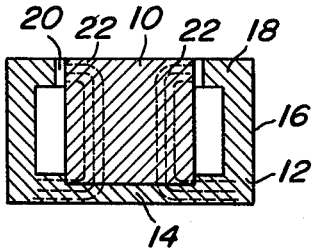
FIG. 1 PRIOR ART
FIG. 1 is a cross-sectional view of a magnetic structure for a loudspeaker.
Figure 2:
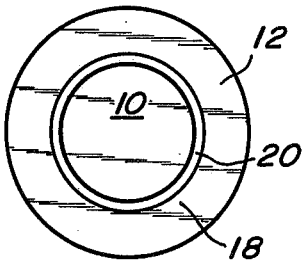
FIG. 2 PRIOR ART
FIG. 2 is a top view of the structure of FIG. 1.

Referring now to the drawings, FIGS. 1 and 2 illustrate the magnetic structure for an electrodynamic loudspeaker of known construction. The magnetic structure includes a permanent magnet 10 which may be of cylindrical configuration. The permanent magnet may be made of various known magnetic materials such as Alnico 5 or Alnico 8. Connected to the permanent magnet 10 is a cup-like return path element 12 having an end portion 14 to which one end of the permanent magnet 10 is connected. The return element has an annular outer portion 16 and an inturned top portion 18. The top portion 18 forms an annular air gap 20 with the top end of the permanent magnet 10.

The density of the flux in the air gap 20 depends upon the magnetization of the permanent magnet 10 and the reluctance of the return path element 12. The effectiveness of the magnet 10 depends upon the manner in which the flux lines are developed therein. The flux path through the air gap requires flux lines which curve from an axial to a radial direction, as shown by the dotted lines 22 in FIG. 1. If the permanent magnet is magnetized so that the flux lines extend axially therethrough, that is directly between the top and bottom surfaces of the cylindrical magnet 10, the effective flux provided in the curved path 22 will be much less than if the magnetization of the permanent magnet 10 is along the dotted lines 22.

Figure 3:
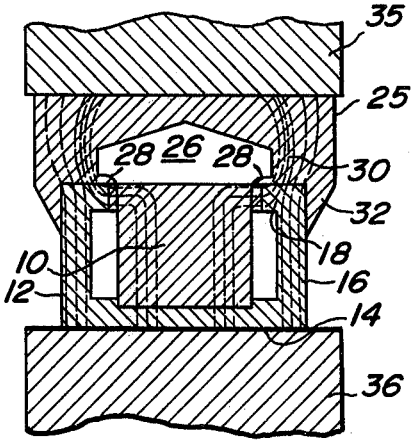
FIG. 3 is a cross-sectional view of the magnetic structure of FIG. 1 with the magnetizing apparatus of the invention coupled thereto for magnetizing the permanent magnet.

FIG. 3 illustrates magnetizing apparatus in accordance with the invention for providing magnetization of the permanent magnet 10 along the curved lines 22 extending from the circumference of the top end of the permanent magnet 10 and curving into the axial direction. The magnetizing apparatus includes a pole piece or element 25 which may be annular in configuration with a recess 26 in the center, and with an annular projection 28 extending into the air gap 20 of the magnetic structure. The pole piece 25 may have a surface 30 engaging the surface of the top portion 18 of the return path element 12, and a rim 32 surrounding the upper part of the outer annular portion 16 of the return path element.

Flux can be applied to the upper pole element 25 from the pole 35 of a standard magnetizing device, which has a lower pole 36 on which the end 14 of the cup-like return path is positioned. This can provide magnetic flux from the pole 35 to the upper pole piece 25 and through the magnetic structure to the lower pole 36. Flux passes through the magnetic structure through two parallel paths, the first extending from the annular projection 28 of the upper pole element 25 from the circumference of the magnet 10 into the magnet and curving axially therein through the magnet to the end 14 of the return element and into the lower pole 36. Since the pole piece 25 has a recess 26 adjacent the top of the magnet 10, very little flux will enter the magnet through the top surface thereof. The second path from the pole element 25 is through the surface 30 into the top portion 18 of the return element through the outer portion 16 thereof into the pole 36. Flux will also enter the outer portion 16 from the rim 32 of the pole element 25.

Inasmuch as the return path element 12 is made of soft iron, the path through this element will have less reluctance than the path through the permanent magnet 10. This will cause the outer annular portion 16 of the return path to saturate when a predetermined flux is applied. Sufficient flux can be applied between the poles 35 and 36 to saturate the portion 16 and to provide flux through the parallel path through the permanent magnet 10 to magnetize the same. The shape of the pole piece 25 and the portion thereof connected to the annular projection 28 which extend into the air gap can be designed to provide the required magnetizing flux to the permanent magnet 10.

Figure 4:
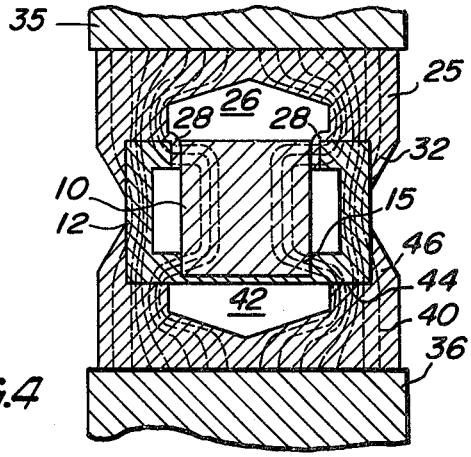
FIG. 4 illustrates magnetizing apparatus in accordance with the invention for magnetizing the permanent magnet of the magnetic structure for a loudspeaker, wherein the permanent magnet is set into a recess in the cup-like return element.

In FIG. 4 there is shown apparatus for magnetizing a magnetic structure which is generally similar to that shown in FIGS. 1 and 2, except that the magnet 10 is set into a cylindrical recess 15 in the bottom of the return element 12. In such case the magnetic flux from the magnet 10 through the return element 12 and the air gap 20 will extend primarily from the magnet 10 through the periphery of the magnet adjacent the bottom thereof into the return element 12. To magnetize the magnet 10 in such a structure, the same upper pole element 25 can be used as is illustrated in FIG. 3. However, to provide the flux path through the magnet at the lower end thereof through the periphery of the magnet, a lower pole piece or element 40 is used which has a recess 42 at the center, and which engages the return element 12 around the periphery of the bottom thereof and around the circumference adjacent the bottom. The annular portion 44 of pole element 40 engages the bottom of the return element around the outer edge thereof, and the annular portion 46 of the lower pole piece 40 engages the return element 12 around the periphery thereof adjacent the bottom. This will provide flux lines as shown by the dotted lines in FIG. 4, which curve downward from the periphery of the permanent magnet 10 near the top thereof, and then extend axially from the top to the bottom of the magnet and again curve outwardly to the periphery.

When the magnet 10 is magnetized and applies flux through the return element 12 and the air gap 20 of the loudspeaker magnetic structure, the flux will follow a generally circular path from the magnet 10 through the return element 12 and the air gap back to the magnet. Although the path through the return element 12 is different than the path during the magnetization, since the element 12 is of soft iron and has low retentivity, the magnetizing path will have essentially no effect on the operative flux path through the return element when the magnetic structure is operating to provide high density flux in the air gap.

Figure 5:
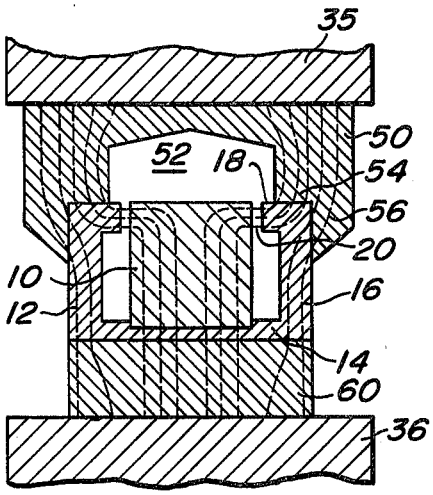
FIG. 5 illustrates another embodiment of the magnetizing apparatus of the invention.

FIG. 5 illustrates magnetizing apparatus for use with a magnetic structure as shown in FIGS. 1 to 3, which is of a different construction. The upper pole element 50 is similar to the upper pole element 25 of FIG. 3, but does not have a portion extending into the air gap 20. The recess 52 in the upper pole element 50 is larger to further decrease the magnetic flux which might flow from the element 50 into the top surface of the permanent magnet 10. The upper pole element 50 has an annular surface 54 engaging the top surface of the top portion 18 of the return element 12, and a rim 56 surrounding the periphery of the top portion 18.

The upper pole element 50 provides flux which flows through the air gap into the permanent magnet 10, from the periphery of the top end thereof, as shown by the dotted lines. Flux will also flow through the annular portion 16 of the return path element 12, and will saturate this portion as described in connection with the prior embodiments of the magnetizing apparatus.

A lower pole element 60 is provided for completing the magnetic path from the bottom 14 of the return path element 12 to the lower pole 36 of the magnetizing apparatus. This can be made of material having very high magnetic saturation so that the flux is better distributed therethrough. Such a lower pole element can also be used in the embodiment of FIG. 3. The structure of FIG. 5 has been found to provide the highly uniform flux density in the air gap of the speaker magnetic structure.

The magnetizing pole elements 25, 40, 50 and 60 should be made of material having very high magnetic saturation so that the flux is effectively distributed therethrough. Material such as Vanadium Permendur which is available from the Allegheny Lundlum Company is suitable for use in the pole elements.

Figure 6:
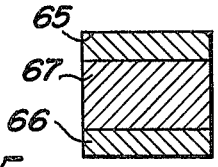
FIGS. 6 and 7 illustrate an alternate embodiment of the permanent magnet of the magnetic structure for a loudspeaker with which the invention can be used.
Figure 7:
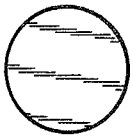

FIGS. 6 and 7 illustrate a magnet configuration which can be used in place of the magnet 10 in FIGS. 1 to 4. In this construction, the cylindrical magnet has a top portion or layer 65, a bottom layer 66 and an intermediate section 67. When the magnet is magnetized as described in connection with either FIGS. 3 or 4, the flux lines will curve within the top layer 65, and when the structure of FIG. 4 is used, the flux lines will also curve in the bottom layer 66. However, in both cases the flux lines through the intermediate section 67 will be axial. When using a magnet of this construction, the top layer 65 and the bottom layer 66 can be formed of isotropic magnet material and the intermediate section 67 can be formed of anisotropic magnet material. This will permit magnetization of the magnet so that curved flux lines are produced in the top layer 65 and/or the bottom layer 66, as described in connection with the magnetizing apparatus illustrated in FIGS. 3 and 4. Since the flux in the intermediate section 67 of the magnet is axial in all cases, this section can be easily formed of anisotropic material.

The apparatus and method of magnetizing the permanent magnet of a magnetic structure which has been described results in a significant improvement in efficiency as compared to prior methods. The apparatus utilized is quite simple and can be provided at relatively low cost. This method and apparatus is particularly applicable for magnetizing the magnetic structure for a loudspeaker, and can also be used for other applications.

I claim:

1. The method of magnetizing the cylindrical permanent magnet of a magnetic structure which has an annular magnetic return path element connected to and in physical contact with the permanent magnet at one end thereof and which element forms an annular air gap with the permanent magnet adjacent the opposite end thereof, which method includes the steps of:

applying magnetic flux from the air gap through the periphery of the cylindrical permanent magnet and axially therein to the return path element adjacent the one end of the permanent magnet and through a parallel flux path in the return path element, and increasing the flux applied until the parallel flux path in the return path element is saturated and the magnetizing flux through the permanent magnet provides the desired magnetization thereof.

2. The method of claim 1 wherein the flux is applied from the air gap through the periphery of the cylindrical permanent magnet, axially through the magnet and then through the periphery of the magnet at the one end thereof into the return path element.

3. Apparatus for magnetizing the permanent magnet of a magnetic structure which includes a return path element for completing the flux path, and wherein the permanent magnet has a first end connected to the return path element and a second end forming an air gap with the return path element, such apparatus including in combination:

a first magnetizing pole element having a portion for providing flux to the permanent magnet of the magnetic structure from the air gap thereof, a second magnetizing pole element adapted to be coupled to the return path element adjacent said first end of the permanent magnet, and means coupled to said first and second magnetizing pole elements for providing magnetizing flux through the permanent magnet and through a parallel path in the return path element, such magnetic flux saturating a portion of the parallel path and providing magnetization of the permanent magnet.

4. Apparatus in accordance with claim 3 wherein said first magnetizing pole element has a configuration to apply sufficient flux from said air gap into the permanent magnet to provide a particular level of magnetization of the permanent magnet.

5. Apparatus in accordance with claim 3 wherein said first magnetizing pole element has a portion adapted to be inserted into the air gap of the magnetic structure.

6. Apparatus for magnetizing the cylindrical permanent magnet of an annular magnetic structure wherein the permanent magnet has a first end connected to a cup-like return path element and a second end forming an annular air gap with an annular portion of the return path element, such apparatus including in combination:

a first magnetizing pole element having an annular portion adapted to engage the return path element adjacent the air gap of the magnetic structure, a second magnetizing pole element adapted to be coupled to the return path element adjacent the first end of the permanent magnet, and means coupled to said first and second magnetizing pole elements for providing magnetizing flux through the permanent magnet and through a parallel path in the return path element, such magnetic flux saturating a portion of the parallel path and providing the desired magnetization of the permanent magnet.

7. Apparatus in accordance with claim 6 wherein said first magnetizing pole element has a cavity therein adjacent the second end of the magnet.

8. Apparatus in accordance with claim 6 wherein said first magnetizing pole element has an annular projecting portion adapted to extend into the air gap of the magnetic structure.

9. Apparatus in accordance with claim 8 wherein said annular projecting portion of said first magnetizing pole element is constructed to cause the magnetizing flux to enter the permanent magnet at the periphery of the second end of the magnet, and such flux passes through a path which curves and extends axially through the magnet to the first end thereof.

10. Apparatus in accordance with claim 7 wherein said second magnetizing pole element has an annular portion engaging the return path element about the first end of the permanent magnet, whereby the magnetizing flux is applied to the permanent magnet in a path extending from the air gap through the periphery of the magnet at the second end thereof, then axially through the magnet, and from the periphery of the magnet at the first end thereof into the return path element.

* * * * *